US006146257A

United States Patent [19]

Himeno et al.

[11] Patent Number: 6,146,257

[45] Date of Patent: Nov. 14, 2000

[54] MANUALLY-OPERATED SHARPENING APPARATUS

[75] Inventors: Kazuko Himeno, 1-4, Tomiokagojo 3-chome, Teine-ku, Sapporo-shi, Hokkaido; Hiroshi Himeno, Sapporo, both of Japan

[73] Assignees: Kazuko Himeno, Hokkaido; Hakusui Trading Co., Ltd., Osaka, both of Japan

[21] Appl. No.: 09/181,652

[22] Filed: Oct. 29, 1998

[30] Foreign Application Priority Data

Jul. 7, 1998 [JP] Japan ..... 10-191750

[51] Int. Cl.[7] ..... B24B 3/36

[52] U.S. Cl. ..... 451/321; 451/371; 76/82

[58] Field of Search ..... 451/321, 371, 451/164; 76/82

[56] References Cited

U.S. PATENT DOCUMENTS

| | | | |
|---|---|---|---|
| 2,287,910 | 6/1942 | Slack | 451/164 |
| 2,324,025 | 7/1943 | Revell | 451/164 |
| 2,391,260 | 12/1945 | Miller et al. | 451/164 |
| 2,578,081 | 12/1951 | Miller et al. | 451/164 |
| 4,509,268 | 4/1985 | Marquam et al. | 451/164 |
| 4,821,462 | 4/1989 | Moore | 451/371 |

FOREIGN PATENT DOCUMENTS

| | | | |
|---|---|---|---|
| 115922 | 5/1918 | United Kingdom | 451/164 |
| 825036 | 12/1959 | United Kingdom | 451/164 |

*Primary Examiner*—Robert A. Rose
*Attorney, Agent, or Firm*—Birch, Stewart, Kolasch & Birch, LLP

[57] ABSTRACT

A manually-operated sharpening apparatus includes a sharpening member for sharpening a sharpened member such as a dental instrument, a guide member for guiding the sharpened member so as to be movable therealong, and a positioning-assist element for permitting an operator to dispose the sharpened member at a location at which a predetermined angle is formed between the sharpened member and the sharpening member. With use of the sharpening apparatus, the operator can easily sharpen a blade of the sharpened member at a desired blade angle.

13 Claims, 7 Drawing Sheets

MANUALLY-OPERATED SHARPENING APPARATUS

BACKGROUND OF THE INVENTION

1. Technical Field

The present invention relates to a manually-operated sharpening apparatus, and more particularly, to a sharpening apparatus suited to sharpen dental instruments.

2. Related Art

In dental treatments, various types of bladed dental instruments are employed. Especially, scalers are widely employed for scaling tartar and dental plaque on the teeth and for root-planing periodontal faces of the teeth.

As shown in FIG. 1, a typical scaler 9 is comprised of a handle 9*a* adapted to be grasped by an operator in his or her hand and a shank 9*b* extending from the handle 9*a* and having a distal end portion thereof formed with a bladed portion 9*c*. The bladed portion 9*c* has an upper flat face 9*d* which crosses lateral edges of an peripheral face 9*e* of the blade, to form two ridge lines, i.e., two tips 9*f* of the blade.

To meet conditions for dental treatments which vary in dependence on types of dental treatments as well as shapes and parts of the teeth subjected to dental treatments, a distal half of the shank 9*b*, including the blade 9*c*, is formed into a simple straight-line shape or a complicated shape which is curved in three dimensions. For instance, the scaler 9 is formed into a hoe type, sickle type, chisel type, or currette type.

In order to efficiently carry out dental treatments such as scaling and root planing to thereby enhance therapeutic effects, it is important to maintain the sharpness of a scaler. Normally, a scaler has a sufficient sharpness if a blade angle θ (FIG. 2) thereof formed between the upper face 9*d* and the peripheral face 9*e* of the blade falls within a range varying from 70 deg to 80 deg, with the bladed portion 9*c* of the scaler sharpened satisfactorily.

The sharpness of a blade is liable to be deteriorated during the time the scaler is used for scaling tartar on the teeth or for root-planing the teeth, for instance. Thus, the sharpness of the scaler blade is checked before and during the use of the scaler, and the scaler is sharpened as required to maintain a desired sharpness.

The aforementioned sharpening may be made manually or with use of an electric sharpening apparatus.

Manual sharpening is carried out by an operator by causing a relative movement between the scaler grasped in his or her hand and a sharpening stone held in another hand. Such manual sharpening can be made easily and is hence convenient for the operator to sharpen the scaler blade with ease during the dental treatment. However, manual sharpening requires skills in sharpening the scaler in a manner providing the scaler with an appropriate blade angle. Since the sharpening skills greatly vary among individual operators, it is especially difficult to maintain a suitable blade angle if the same scaler is commonly used and sharpened by a number of operators.

In the case of using an electric sharpening apparatus which typically comprises a sharpening-stone driving section, including an electric motor, for causing a sharpening stone to rotate or rectilinearly move, sharpening is made by depressing the sharpening stone against the scaler. However, the electric sharpening apparatus has several drawbacks. First, the scaler blade can be sometimes sharpened excessively. Further, much time is required for setting. This makes it difficult to carry out sharpening of the scaler with ease during the dental treatment. Moreover, the electric-operated sharpening apparatus is large in size and complicated in structure, and is hence high-priced. In addition, the sharpening apparatus which accommodates therein electric components is difficult to be subject to sterilization in its entirety at a time. Moreover, it is difficult to maintain cleanness of the sharpening stone.

SUMMARY OF THE INVENTION

An object of the invention is to provide a manually-operated sharpening apparatus for sharpening a blade of dental instruments or other bladed tools.

A manually-operated sharpening apparatus according to the present invention comprises a sharpening member for sharpening a workpiece, such as a bladed tool; a guide member for guiding the workpiece so as to be movable along the guide member; and a positioning-assist element for permitting an operator to dispose the workpiece in a state where a predetermined angle is formed between the workpiece and the sharpening member.

Preferably, the sharpening apparatus includes a base plate having a flat face. The guide member is fixed to the flat face of the base plate. The positioning-assist element is comprised of a positioning line drawn on the flat face of the base plate and extending at the predetermined angle with respect to the guide member. More preferably, the guide member is formed on the flat face of the base plate integrally therewith. Alternatively, the guide member is disposed on the flat face of the base plate so as to be pivotable around one end of the guide member, and is adapted to be fixed at an arbitrary pivotal angular position. More preferably, the guide section includes an arcuate member fixed to the flat face of the base plate. As the guide member is pivoted, another end of the guide member moves along the arcuate member.

Preferably, the sharpening apparatus includes a holder, adapted to be placed on a flat face of a base, for holding the guide member in a state that the guide member extends at the predetermined angle with respect to the flat face of the base in an imaginary vertical plane which extends perpendicularly to the flat face of the base. The positioning-assist element is comprised of an orientation-confirming member detachably mounted to the workpiece and having a horizontal-indicating portion, adapted to be placed on a flat face of the workpiece, for permitting the operator to visibly judge whether the flat face of the workpiece is disposed in parallel to the flat face of the base, the flat face of the workpiece being adjacent to a sharpened face of the workpiece and cooperating with the sharpened face to form a blade of the workpiece. Alternatively, the positioning-assist element is comprised of a hand rest on which an operator rests his or her hand. The hand rest has a peripheral wall thereof formed with a cutout portion through which the operator is enabled to project the workpiece. The peripheral wall of the hand rest has an inner surface on which at least one guide line is drawn. The operator is enabled to dispose the workpiece such that the predetermined angle is formed between the sharpened member and the workpiece, by disposing the sharpened member in alignment with the at least one guide line.

With the sharpening apparatus of the present invention, the operator is enabled to sharpen the workpiece in a manner providing the workpiece with a desired blade angle by simply moving the sharpening member along the guide member in a condition that the workpiece is in contact with the workpiece mounted to the guide member after the sharpened member is positioned by utilizing the positioning-assist element. This eliminates or reduces the need of sharpening skills and individual differences in sharpened blade angle. Further, sharpening can be carried out while a sharpened state of the blade of the workpiece is checked with ease, so that excessive sharpening can be prevented. Repeated sharpening actions in which the operator moves the sharpening member at a given angle along the guide member permit the operator to be highly trained in the use of the sharpening member for manual sharpening. In other words, the sharpening apparatus serves as a training apparatus. The sharpening apparatus which accommodates therein no electric components or other complicated components is simple in construction and can be assembled at low costs. In addition, the sharpening apparatus can be subject in its entirety to chemical sterilization, autoclave sterilization, gas sterilization or other sterilization.

With the preferred sharpening apparatus having the guide member provided two-dimensionally on the base plate, the workpiece can be sharpened with ease by moving the sharpening member on the base plate.

With the preferred sharpening apparatus having the guide member provided three-dimensionally to extend in a three-dimensional space above the base, sharpening can be carried out even in respect of the workpiece having a complicated shape.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION

A manually-operated sharpening apparatus according to a first embodiment of the present invention will be explained hereinbelow.

Figure 1:
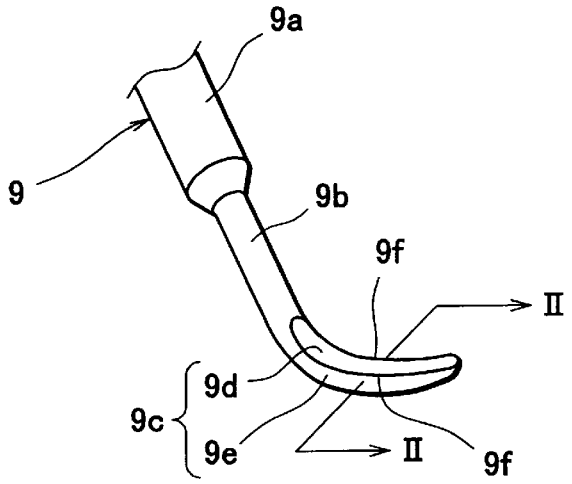
FIG. 1 is a perspective view showing a distal end portion of a scaler.
Figure 3:
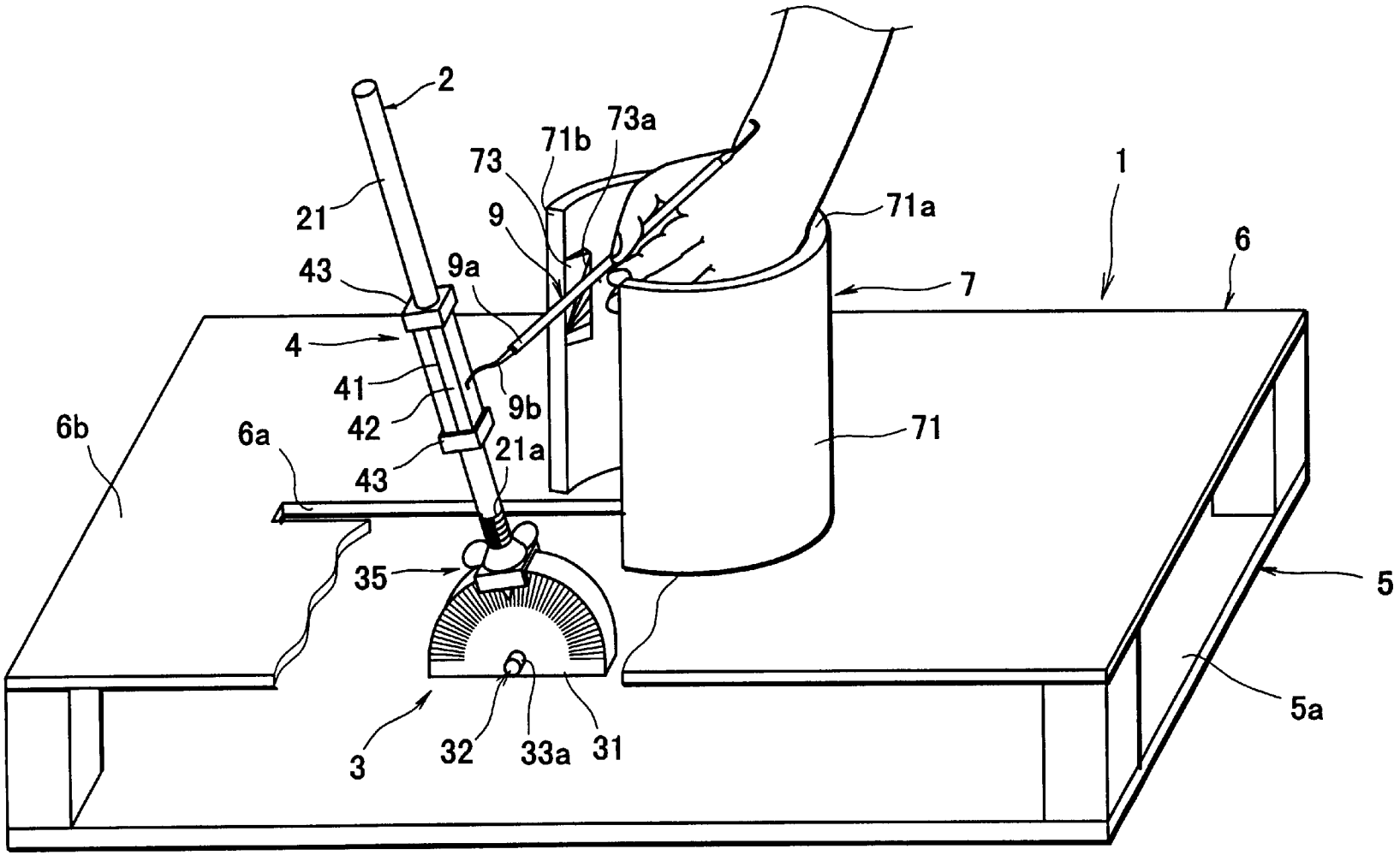
FIG. 3 is a perspective view showing primary parts of a sharpening apparatus according to a first embodiment of the present invention.

Referring to FIG. 3, the sharpening apparatus 1 includes a sharpening stone assembly (sharpening section) 4 which has two square pillar-like sharpening stones (sharpening members) 41 and 42, preferably having different roughness, for sharpening a blade of a scaler (sharpened member) 9 typically constructed as shown in FIG. 1, and which assembly has two connection caps 43 made of synthetic resin and respectively fitted on opposite end portions of the sharpening stones. Preferably, each of the sharpening stones 41 and 42 has a primary outer surface thereof formed into a flat face. For the convenience of sharpening a tip end portion and a recessed portion, if any, of the scaler 9, one end surface of the scaler is formed into a convex face, and another end surface thereof is formed into a concave face.

Each of the sharpening stones 41 and 42 has an inner side surface thereof formed with a semi-cylindrical groove. Each cap 43 has its end wall formed with an insertion hole extending in alignment with a cylindrical hole defined by the two semi-cylindrical grooves of the sharpening stones. The sharpening stone assembly 4 is supported by a rod (guide member) 21 for straight-line movement along the rod 21 which extends through the cylindrical hole and the insertion hole. Although the rod 21 shown in FIG. 3 has a circular cross sectional shape so as to be rotatable around its longitudinal axis, it may be formed into a polygon shape in cross section to improve the sharpening accuracy by prohibiting the rotation of the rod around the axis.

The holder 3 which cooperates with the rod 21 to form a guide section for guiding the sharpening stone assembly 4 has a bottom wall and two semicircular plates 31 formed at opposite lateral edges of the bottom wall and defining a space for receiving a proximal end portion of the rod 21. One or both of the semicircular plates 31 are formed with an angle index. The rod 21 is supported by a fixture, comprised of a screw and a nut threadedly engaged therewith, so as to be angularly movable around the origin of the angle index between the two semicircular plates 31. The screw of the fixture extends through a hole formed in the proximal end portion of the rod 21 and passes through the origin of the angle index. The rod 21 is adapted to be fixed at an arbitrary angular position by a stopper 35 which comprises a presser plate mounted across the semicircular plates 31 and formed with a hole permitting the rod 21 to pass therethrough, and an wing nut 38, threadedly engaged with a male thread 21*a* of the rod 21, for pressing the presser plate against the semicircular plates 31.

The holder 3 is disposed between a level block 5 and a base plate 6 placed on the block in parallel thereto. The base plate 6 is formed with an elongated rectangular hole 6*a* through which the rod 21 extends.

Figure 4:
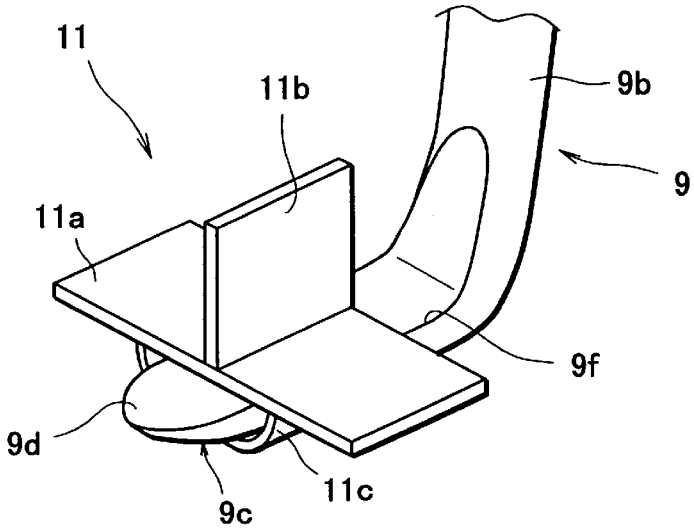
FIG. 4 is an orientation-confirming member which cooperates with the primary parts shown in FIG. 3 to constitute the sharpening apparatus.

The sharpening apparatus 1 further comprises positioning-assist elements 7 for permitting an operator to easily position the scaler 9 at a location where the sharpened face of the scaler is in contact with the sharpening face of the sharpening stone 41 or 42 and where a predetermined angle is formed between the scaler and the sharpening stone. In the present embodiment, the positioning-assist elements 7 include a hand rest 71 and an orientation-confirming member (FIG. 4).

The hand rest 71 has a peripheral wall thereof having an upper peripheral edge portion 71*a* on which the operator rests his or her hand holding the scaler 9 with stability and a cutout portion 71*b* through which the tip half portion of the scaler 9 is permitted to extend to the outside. A plate 73 on which a desired number of guide lines 73*a* is drawn is mounted to the inner surface, in the vicinity of the cutout portion 71*b,* of the peripheral wall of the hand rest 71. The operator is enabled to set the inclination of the axis of the handle 9*a* of the scaler 9 at a desired angle by holding the scaler 9 such that the handle axis is in alignment with a desired one of the guide lines 73*a,* with the upper face 9*d* of the blade 9*c* of the scaler 9 directed upward, whereby the upper face 9*d* of the blade is disposed in nearly parallel to the surface 5*a* of the level block 5 and the flat surface 6*b* of the base plate 6.

The orientation-confirming member 11 makes it easy for the operator to dispose the scaler 9 such that the upper face 9*d* of the scaler blade is in exactly parallel to the surface 5*a* of the level block 5. The confirming member 11 is comprised of a horizontal-indicating plate 11*a* adapted to be placed on the upper face 9*d* of the scaler 9, a vertical-indicating plate 11*b* fixed to an upper face of the horizontal-indicating plate 11*a* and extending perpendicularly therefrom, and an annular elastic member 11*c* fixed to a lower horizontal face of the horizontal-indicating plate 11*a.* By confirming the directions to which the horizontal and vertical-indicating plates 11*a* and 11*b* of the confirming member 11 placed on the upper face 9*d* of the scaler blade are directed, the operator can easily confirm the orientation of the upper face 9*d* of the scaler blade. This makes it possible for the operator to accurately dispose the upper face 9*d* in parallel to the surface 5*a* of the level block 5.

In the following, explanations will be given as to how the scaler 9 is sharpened with use of the sharpening apparatus 1.

At first, the rod 21 is rotated around the origin of the angle index to an angular position at which a pointer attached to the stopper 35 indicates a desired angle, e.g., 78 deg. Then, the rod 21 is fixed to the holder 3 at this angular position by tightening the wing nut 38.

Next, the holder 3 to which the rod 21 is fixed is placed on the level block 5, and the base plate 6 is placed on four corner legs of the block 5 with the rod 21 received in the elongated hole 6*a* of the base plate 6, whereby the holder 3 is placed between the level block 5 and the base plate 6. Then, the sharpening stone assembly 4 is mounted to the rod 21, and the position at which the holder 3 is placed on the level block 5 is so adjusted that the side edges of the bottom wall of the holder 3 are in parallel to the side edges of the elongated hole 6*a*. As a result, the rod 21 extends in an imaginary vertical plane extending perpendicularly to the surface 5*a* of the level block at a predetermined angle of, e.g., 78 deg with respect to the block surface 5*a*.

Next, the operator places the hand rest 71 on the base plate 6, grasps the scaler 9 in his or her hand with the upper face of the scaler blade directed upward, and places the hand on the upper peripheral edge 71*a* of the hand rest 71. Thereafter, the operator adjusts the extending direction of the scaler 9 such that, typically, the axis of the handle 9*a* becomes perpendicularly to the elongated hole 6*a* as viewed from the above, while slidingly moving the hand rest 71 on the base plate 6 where desired.

Subsequently, the operator disposes the scaler 9 in such a manner that the handle axis Is aligned with a desired guide line 73*a,* attaches the orientation-confirming member 11 to the scaler 9, and adjusts the orientation of the scaler 9 to bring the upper face 9*d* of the scaler blade in parallel to the upper face of the base plate 6, while confirming the orientations of the horizontal-indicating and vertical-indicating plates 11*a* and 11*b* of the confirming member 10. After completion of the scaler orientation adjustment, the confirming member is detached from the scaler 9. Further, the operator brings the tip of scaler blade to be in contact with the sharpening face of the first sharpening stone 41 of the sharpening stone assembly 4 held in another hand, while maintaining the adjusted orientation of the upper face 9*d* of the scaler blade, and causes the assembly 4 to slide along the rod 21 in one direction.

Since the rod 21 of the sharpening apparatus 1 extends at a desired angle of 78 deg with respect to the face 5*a* of the level block 5 in an imaginary vertical plane perpendicular to the block surface 5*a,* a sharpening face of the sharpening stone assembly 4 is moved at the angle of 78 deg with respect to the block surface 5*a* when the assembly is caused to move along the rod 21. For this reason, by causing the sharpening stone assembly 4 to move several times in one direction relatively to the scaler 9 which is held in a state that the upper face 9*d* of the scaler blade is in parallel to the block surface 5*a,* that part of one side of the peripheral face 9*e* of the scaler blade which is kept in contact with the sharpening stone assembly 4 is sharpened at an angle of 78 deg, whereby a sharp blade tip 9*f* is obtainable (refer to FIGS. 1 and 2). In sharpening the scaler 9, as the sharpening stone assembly 4 is moved in the returning direction which is opposite to the sharpening direction, the scaler 9 is slightly moved away from the rod 21 to bring the scaler to be out of contact with the sharpening stone assembly 4 which is moving in the returning direction, to thereby prevent burrs from being formed. Thus, the deterioration in sharpness of the scaler 9 resulting from the presence of burrs can be avoided. Such burrs would be formed if the sharpening stone assembly 4 is reciprocated under a condition that the scaler is in contact with the assembly 4.

While changing the lengthwise part of the scaler blade 9*c* which is abutted against the sharpening stone assembly 4, the operator manually sharpens respective lengthwise parts of the blade 9*c* with use of the sharpening stone assembly 4, whereby the entirety of the tip of the blade 9*c* is sharpened.

After rough sharpening by means of the first sharpening stone 41 is completed, the sharpening stone assembly 4 is rotated around the rod 21 so that the second sharpening stone 42 for finish sharpening is positioned at a location where it can be in contact with the scaler 9.

If sharpening of the scaler 9 has been completed, the sharpening stone assembly 4 may be detached from the rod 21 and received in a clean storage instrument such as a tray. With the sharpening apparatus of this embodiment, only the connection caps 43 are brought in contact with that surface of the storage instrument on which the sharpening stone assembly 4 is placed. Thus, the sharpening face of the sharpening stone is prevented from being brought in direct contact with the surface of the storage instrument, whereby the cleanness of the sharpening stone can be maintained satisfactorily and damages to the surface of the storage instrument, attributable to the placement of the stone assembly thereon, can be prevented.

The foregoing explanations have been made for the case where the sharpening apparatus is employed in a condition that the holder 3 is disposed between the level block 5 and the base plate 6 on which the hand rest 7 is placed. However, the sharpening apparatus may be also employed on a desk or a table, for instance.

In the following, a manually-operated sharpening apparatus according to a second embodiment of the present invention will be explained.

Figure 5:
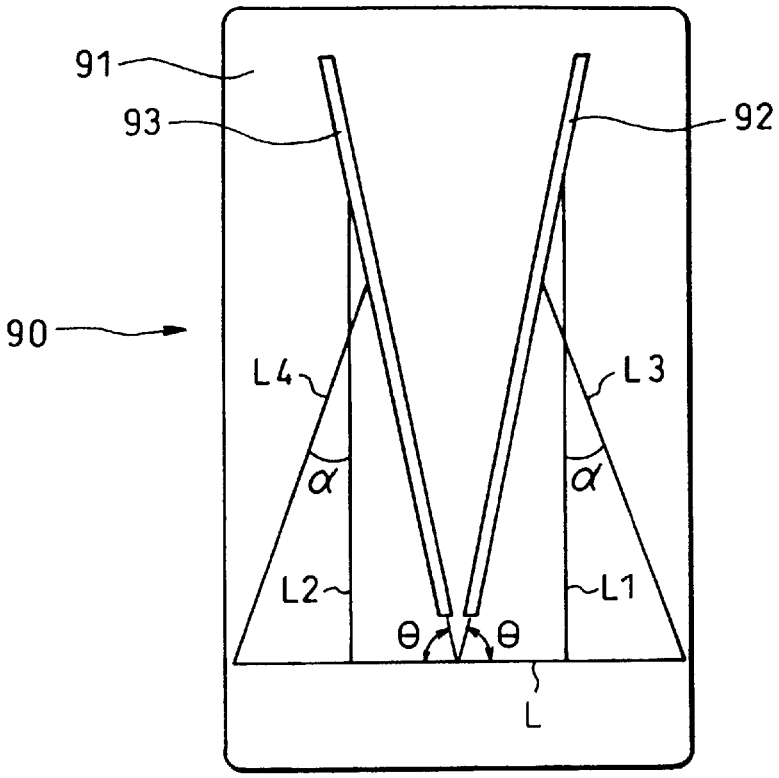
FIG. 5 is a plan view showing a base plate of a sharpening apparatus according to a second embodiment of the present invention, together with guide members formed in the base plate integrally therewith.

As shown in FIG. 5, the sharpening apparatus 90 comprises a base plate 91 and guide members 92, 93 serving as a guide section and fixed to a surface of the base plate. Preferably, the guide members are formed on the surface of the base plate integrally therewith. Each of the guide members 92 and 93 is comprised of a rod which is rectangular in cross section and obliquely extends at a predetermined angle θ (78 deg, for instance) with respect to a reference line L drawn on the surface of the base plate 91. The guide members 92 and 93 have their proximal ends disposed close to each other and distal ends thereof disposed remote from each other, to form a V-shape, as a whole.

Further, a first pair of positioning lines L1, L2 and a second pair of positioning lines L3, L4 are drawn on the surface of the base plate 91. These positioning lines L1–L4 serve as positioning-assist elements for permitting the operator to easily position a scaler 9 with respect to the guide members 92 and 93. Each of the positioning lines L1 and L2 extends longitudinally of the base plate 91 from a predetermined widthwise position on the reference line L to that lengthwise position on an associated one of the guide members 92 and 93 which is spaced from the proximal end of the associated one guide member by a distance nearly equal to two-third of the entire length of the guide member. Each of the positioning lines L3 and L4 obliquely extends from a corresponding one end of the reference line L to a central lengthwise position on the guide member 92 or 93 at a predetermined angle a (twenty degrees, for instance) with respect to the positioning line L1 or L2.

Figure 2:
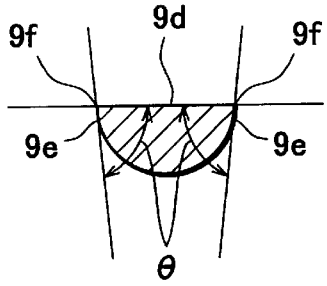
FIG. 2 is a sectional view of the scaler taken along line II—II shown in FIG. 1.
Figure 14:
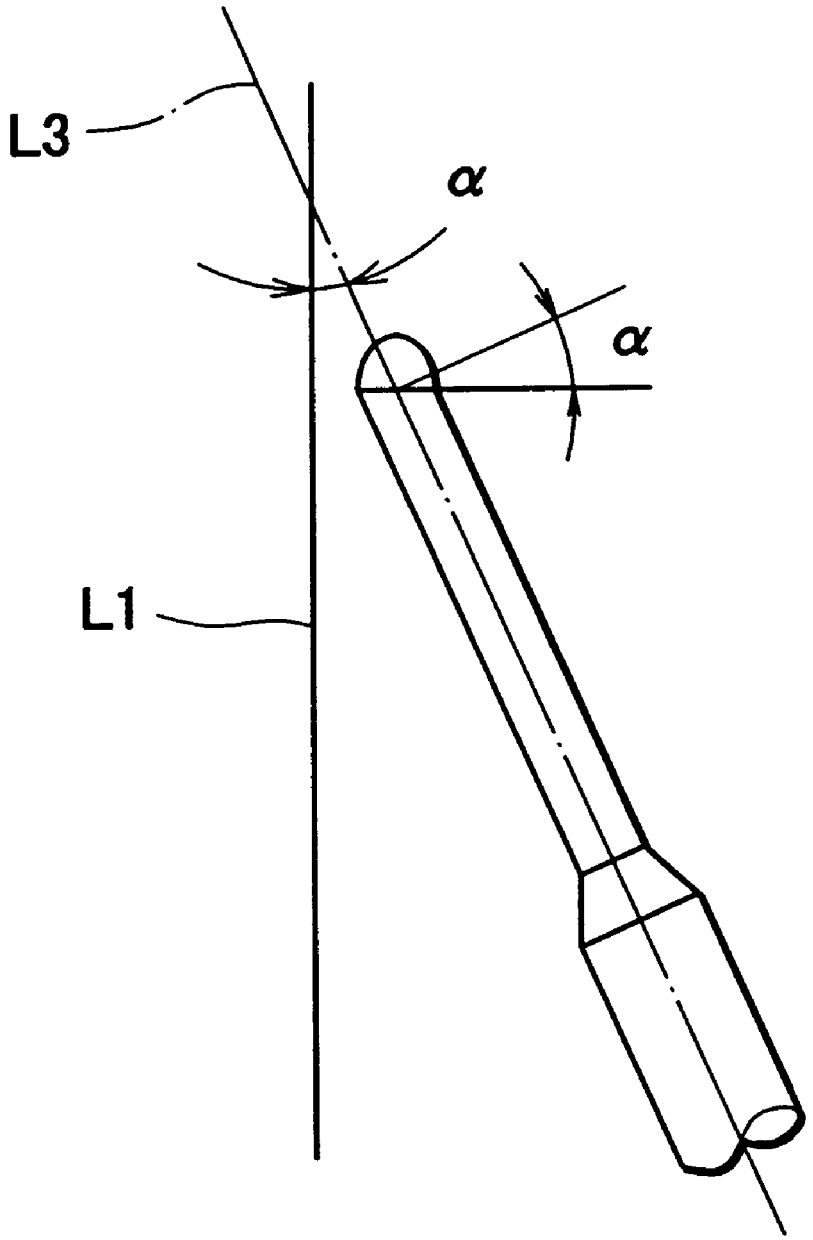
FIG. 14 is a schematic view exemplarily showing a relationship between an angle, formed between the axis of a last shank and an upper blade face in a Gracey type scaler, and an angle formed between a positioning line used to position a Universal type scaler and a corresponding positioning line used to position a Gracey type scaler.

The sharpening apparatus of this embodiment is configured with an intention that the positioning lines L1 and L2 are utilized, e.g., for the sharpening of a Universal type scaler whereas the positioning lines L3 and L4 are utilized, e.g., for a Gracey type scaler. The Universal type scaler has its blades at both the opposite lateral edges of a bladed portion 9*c* which is formed into a straight-line shape, and, as shown in FIG. 2, the upper face 9*d* of the bladed portion extends at nearly 90 deg with respect to the axis of the last shank of the scaler. On the other hand, the Gracey type scaler has its blade solely at an outer convex lateral edge of a curved bladed portion 9*c*, and as shown in FIG. 14, the upper face 9*d* of the bladed portion extends, e.g., at nearly 70 deg with respect to the axis of the last shank. The inclination angle of the upper face 9*d* with respect to a place extending perpendicularly to the axis of the last shank is in the order of 20 deg, for instance, and is equal to an angle a formed between the positioning line L3 or L4 and the positioning line L1 or L2. In other words, the angle a formed between these positioning lines is determined in dependence on the inclination angle of the upper face 9*d* of the bladed portion with respect to the last shank.

A number of pairs of positioning lines may be provided to make it easy to accurately position various types of scalers (a plurality of Gracey type scalers, for instance, which are different in their specifications from one another), including a scaler having a shank which is formed into a three-dimensionally curved shape.

Figure 6:
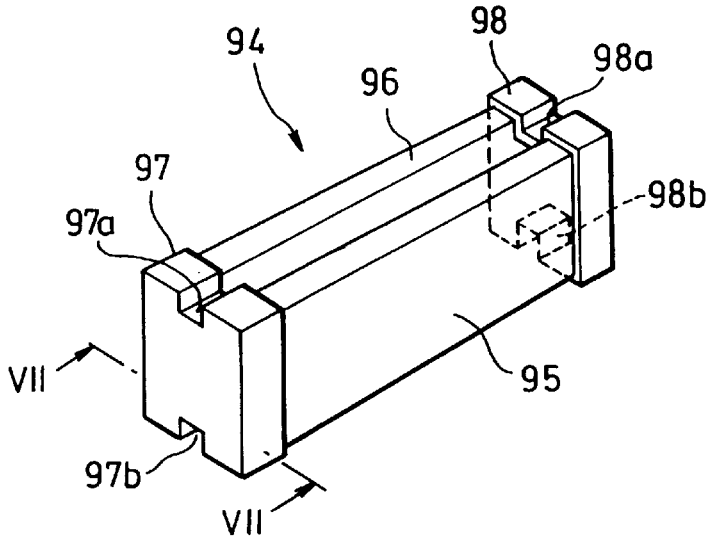
FIG. 6 is a perspective view showing a sharpening stone assembly which cooperates with the base plate and the guide members shown in FIG. 5 to constitute the sharpening apparatus.
Figure 7:
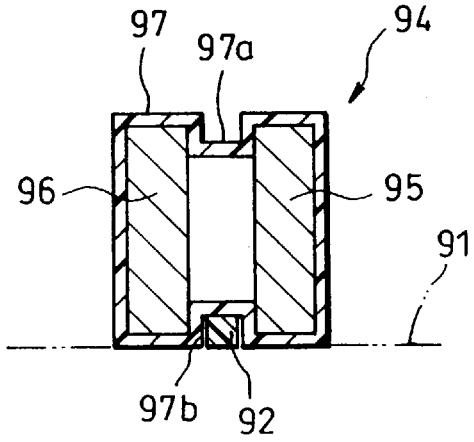
FIG. 7 is a sectional view showing the sharpening stone assembly taken along line VII—VII of FIG. 6.

As shown in FIG. 6, a sharpening stone assembly 94 is comprised of two sharpening stones 95 and 96 each formed into a square pillar shape and each having opposite ends thereof lightly pressed into or screw-fastened to caps 97 and 98, whereby the sharpening stones 95 and 96 are supported in parallel to each other with a predetermined gap therebetween. The caps 97 and 98 are formed at central parts of their upper and lower faces with guide grooves 97*a*, 97*b*; 98*a*, 98*b* which extend longitudinally and which are formed into a square shape in cross section. The guide grooves 97*a* and 97*b* have a depth which is substantially the same as the height of the guide member 92 and have a width slightly (e.g., about 1 mm) wider than the width of the guide member 92. The same is applied to the guide grooves 98*a* and 98*b*.

The caps 97 and 98 are made of corrosion-resistant metallic material such as stainless steel, duralumin, titanium, or hard synthetic resin which can be subject to various types of sterilization such as autoclaving.

In the following, a sharpening method of a scaler with use of the sharpening apparatus will be explained.

Figure 8:
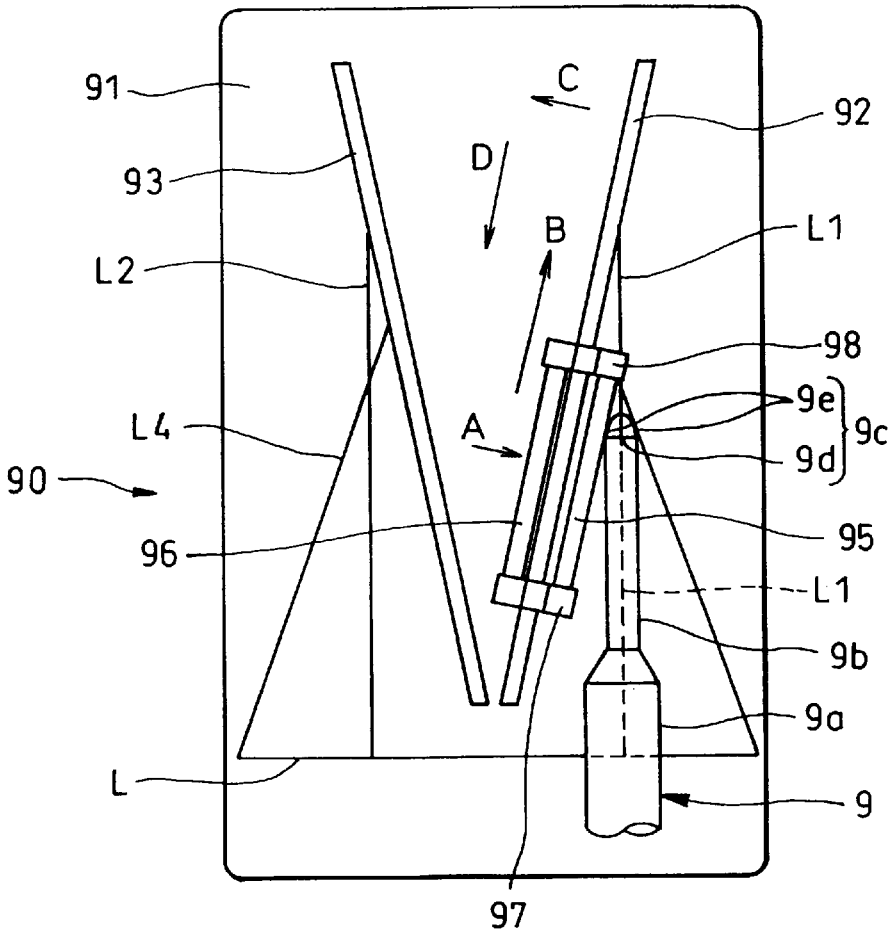
FIG. 8 is a plan view showing a way of using the sharpening apparatus comprised of the elements shown in FIGS. 5 and 6.

After placing the base plate 91 on a desk or a table, the operator causes the lower guide grooves 97*b*, 98*b* of the caps 97, 98 of the sharpening stone assembly 94 to be engaged with the guide member 92 in a state that the assembly 94 is positioned in the vicinity of the proximal end of the guide member 92, as shown in FIG. 8. Then, the operator presses the sharpening stone assembly 94 against the guide member 92 such that the left side faces of the guide grooves 97*b*, 98*b* are in contact with the opposed side face of the guide member 92, as shown by arrow A in FIG. 9. At this time, the bottom faces of the guide grooves 97*b*, 98*b* are in contact with the upper face of the guide member 92 and the bottom faces of the caps 97, 98 are in contact with the upper face of the base plate 91.

Next, the operator grasps the handle 9*a* of the scaler 9 to be sharpened, and causes the tip of the bladed portion 9*c* of the scaler to be directed upward. The operator adjusts the position of the scaler 9 on the surface of the base plate 91 such that, typically, the distal end portion of the handle 9*a* and the shank 9*b* of the scaler are positioned in alignment with the positioning line L1 as seen from the above and the upper face 9*d* of the blade 9*c* is in parallel to the reference line L as seen from the above (FIG. 8). Then, the operator positions the scaler 9 such that the left side face 9*e* of the blade 9*c* is in contact with the right side face of the distal end portion of the sharpening stone 95. At this time, the side face 9*e* of the bladed portion 9*c* of the scaler is in contact with the sharpening stone 95 at a predetermined angle θ of 78 deg.

Figure 9:
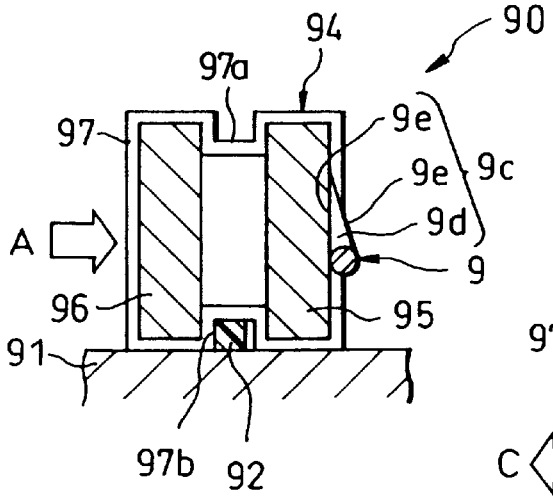
FIG. 9 is a schematic sectional view showing a positional relationship between the sharpening stone assembly, the guide member concerned and a scaler observed when the sharpening stone assembly of the sharpening apparatus shown in FIG. 8 is moved in the sharpening direction.

Subsequently, the operator causes the sharpening stone assembly 94 to move along the guide member 92 from the proximal end side to the distal end side of the guide member as shown by arrow B in FIG. 8, while pressing the sharpening stone assembly 94 toward the direction shown by arrow A in FIGS. 8 and 9, to thereby sharpen the side face 9*e* of the bladed portion 9*c* of the scaler.

Figure 10:
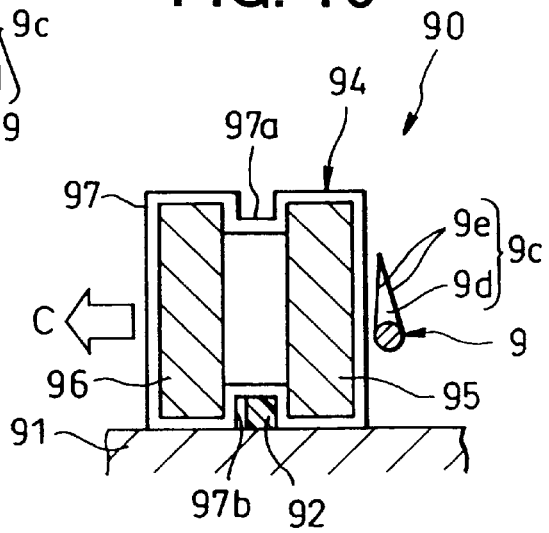
FIG. 10 is a schematic sectional view showing a similar relationship observed when the sharpening stone assembly is moved in the non-sharpening direction.

After moving the sharpening stone assembly 94 to the distal end side of the guide member 92, the operator presses the assembly 94 to the direction shown by arrow C in FIG. 10 to cause the right side faces of the guide grooves 97*b*, 98*b* of the caps 97, 98 to be brought in contact with the right side face of the guide member 92, whereby the sharpening stone 95 is slightly spaced from the side face 9*e* of the blade 9*c* of the scaler. Under this condition, the operator moves back the sharpening stone assembly 94 along the guide member 92 from the distal end side to the proximal end side of the guide member, as shown by arrow D in FIG. 8. During this returning movement of the assembly 94, therefore, the sharpening stone 95 is prevented from interfering with the blade 9*c* of the scaler. By repeating several times the reciprocation of the assembly 94 where the assembly is moved forward with the bladed portion 9*c* kept in contact with the sharpening stone and moved backward with the bladed portion kept out of contact therewith, the left side face 9*e* of the bladed portion 9*c* is sharpened at a predetermined blade angle θ of 78 deg. In this manner, by causing the bladed portion 9*c* to be brought in contact with the sharpening stone only when the sharpening stone assembly 94 is moved forward, the bladed portion 9*c* is sharpened in one direction. As a consequence, no burrs are formed in the bladed portion 9*c*, so that the sharpness of the scaler is improved.

Further, while changing the lengthwise part at which the blade 9*c* is abutted against the sharpening stone assembly 94 and adjusting the posture of the scaler 9 in a manner causing the upper face 9*d* of the scaler blade to be disposed in parallel to the reference line L under visual observations, similar sharpening work is made to thereby sharpen respective lengthwise parts of the blade in sequence.

After the left side face 9*e* of the bladed portion 9*c* of the scaler 9 is sharpened, the operator detaches the sharpening stone assembly 94 from the right guide member 92 and then places the assembly on the left guide member 93 in order to sharpen the right side face 9*e* of the bladed portion 9*c*. In the case that the sharpening stones 95 and 96 of the assembly 94 have different degrees of roughness, the sharpening stone assembly 94 detached from the guide member 92 is turned upside down and reversed from right to left so that the caps 97 and 98 of the assembly are directed to the distal and proximal end sides, respectively, and is placed on the guide member 93 with the guide grooves 97*a* and 98*a* engaged with the guide member 93.

Next, the operator adjusts the position and orientation of the scaler 9 such that the handle 9*a* and the shank 9*b* of the scaler are located on the positioning line L2 and the upper face 9*d* of the blade is in parallel to the reference line L, and repeats the reciprocal movement of the sharpening stone assembly 94 several times along the guide member 93 in which reciprocation the assembly is moved forth with the right side face 9*e* of the bladed portion 9*c* of the scaler being in contact with the side face of the sharpening stone 95 and is moved back with the bladed portion 9*c* being out of contact therewith, whereby the right side face 9*e* of the bladed portion is sharpened at a predetermined angle θ of 78 deg, with no burrs being formed thereon.

Thereafter, similar sharpening work is repeated for respective lengthwise portions of the blade portion 9*c*. In this manner, the operator can rapidly sharpen the bladed portion 9*c* of the scaler 9 with ease.

With use of the sharpening stone assembly 94 comprised of a rough sharpening stone and a finishing sharpening stone, the efficiency of sharpening work can be improved by sharpening both the side faces 9*e* of the bladed portion 9*c* of the scaler in sequence by means of the rough sharpening stone and then sharpening both the side faces of the bladed portion in sequence by the finishing sharpening stone, while easily and rapidly rearranging the sharpening stone assembly 94 between the guide members 92 and 93.

In the case of a Gracey type scaler shown in FIG. 14 and having the bladed portion whose upper face 9*d* is inclined at an angle of a with respect to the last shank in the clockwise direction as seen from the above, an outer side face 9*e* of the bladed portion 9*c* is sharpened in a state where the handle 9*a* and the shank 9*b* are positioned in alignment with the positioning line L3 extending at an angle of a with respect to the positioning line L1. In sharpening an outer side face 9*e* of the bladed portion 9*c* whose upper face 9*d* is inclined in a counterclockwise direction, the scaler is positioned by utilizing the positioning line L4.

Figure 11:
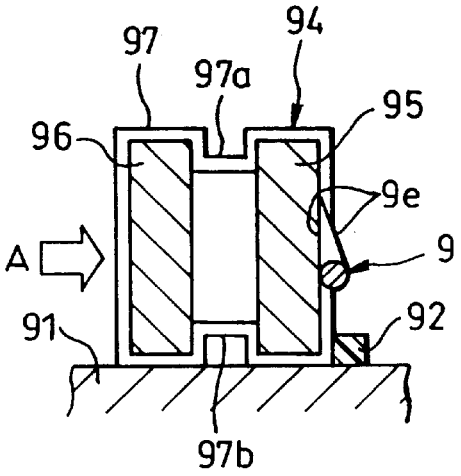
FIG. 11 is a schematic sectional view showing a positional relationship which is observed when the sharpening stone assembly is moved in the sharpening direction and which is different from the relationship shown in FIG. 9.
Figure 12:
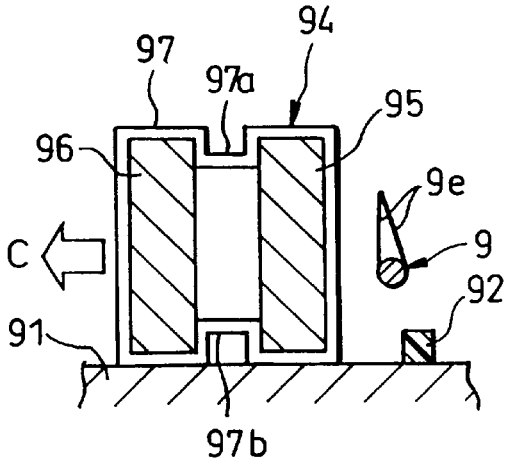
FIG. 12 is a schematic sectional view showing a positional relationship which is observed when the sharpening stone assembly is moved in the non-sharpening direction and which is different from the relationship shown in FIG. 10.

In the sharpening work, the operator is not inevitably required to bring the guide grooves of the caps 97 and 98 of the assembly 94 in engagement with the guide member 92 or 93. That is, the operator can carry out sharpening of, e.g., the right side face 9*e* of the bladed portion 9*c* by moving the sharpening stone assembly 94 from the proximal end side of the guide member 92 to the distal end side thereof while pressing the right side faces of the caps 97 and 98 against the left side face of the guide member 92, as shown in FIG. 11, and by moving back the assembly 94 from the distal end side to the proximal end side after the sharpening stone assembly 94 is spaced from the guide member 92, as shown in FIG. 12. The efficiency of sharpening work can be improved, especially by a skilled operator, by reciprocating the sharpening stone assembly 94 in the above manner.

Instead of the sharpening stone assembly 94 comprised of the two sharpening stones 95 and 96, a single sharpening stone (not shown) may be employed for the sharpening work. Preferably, the single sharpening stone is provided at its front and rear end portions with caps which prevent the sharpening stone from being brought in direct contact with the guide member concerned. The caps for the single sharpening stone does not require the provision of guide grooves and is hence low-priced.

In the following, a manually-operated sharpening apparatus according to a third embodiment of the present invention will be explained.

The sharpening apparatus (shown at reference numeral 100 in FIG. 13) of this embodiment has the same basic construction as that of the apparatus 90 shown in FIG. 5 and is featured in that the angles at which the guide members 92 and 93 extend with respect to the longitudinal axis of the base plate 91 are variably set.

Figure 13:
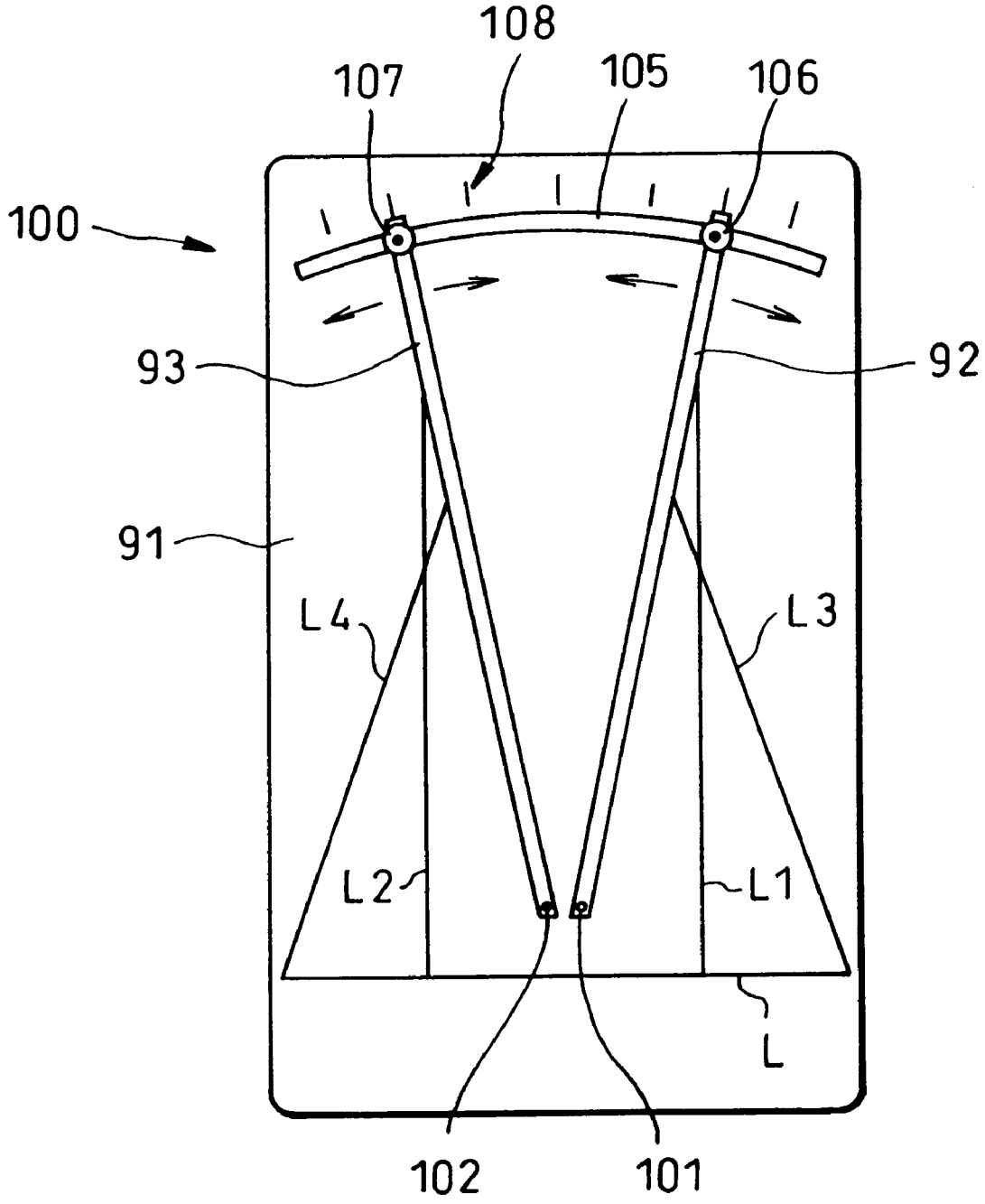
FIG. 13 is a plan view showing a base plate of a sharpening apparatus according to a third embodiment of the present invention, together with guide members which are pivotally supported to the base plate.

More specifically, as shown in FIG. 13, the guide members 92 and 93 are pivotally supported on the base plate 91 at their proximal end portions by means of pins 101 and 102. These guide members are formed at their distal end portions with grooves (not shown) for loosely receiving an arcuate member 105 fixed to the surface of the base plate 91. In this embodiment, the arcuate member 105 is formed on the base plate integrally therewith. Further, the guide members are formed with screw holes into which screws 106 and 107 are threadedly engaged. On the surface of the base plate 91, a reference line L1 and-two pairs of positioning lines L1, L2;

L3, L4 are drawn. On the side remote from the guide members 92 and 93 with respect to the arcuate member 105, an angular index 108 is formed on the surface of the base plate 91.

The operator is permitted to move the distal end portions of the guide members 92, 93 along the arcuate member 105 as shown by arrow in FIG. 13 while pivoting the guide members 92, 93 around the pins 101 and 102, respectively, to thereby vary the angles formed between the guide members and the longitudinal axis of the base plate 91. The pivotal angular positions of the guide members 92 and 93 can be temporarily fixed by fixing the distal end portions of these guide members to the circular member 105 by tightening the screws 106, 107.

Sharpening work using the sharpening apparatus of this embodiment can be made in substantially the same manner as in the case using the apparatus according to the second embodiment. Thus, explanations as to the sharpening work are omitted herein.

A number of pairs of positioning lines may be provided to make it easy to sharpen various types of scalers, other than Universal type scalers, such as one having a shank which has such a complicated shape that an upper face of its bladed portion extends obliquely with respect to the axis of a last shank as in the case of a Gracey type scaler.

The present invention is not limited to the first, second and third embodiments, and may be modified in various manners.

For instance, various modifications may be made in respect of positioning-assist elements of the first embodiment which include the hand rest 7 having a plate 73 on which guide lines 73*a* are drawn and which includes the orientation-confirming member 11 having horizontal and vertical plates 11*a* and 11*b*.

For example, it is not essentially required to provide the hand rest 71 with the guide line plate 73. Only the orientation-confirming member 11 may be employed as a positioning-assist element. In this case, the hand rest may be employed by an operator in order to stably maintain his or her hand in place. Alternatively, the hand rest 71 provided with the guide line plate 73 may be employed singly in positioning the scaler, without utilizing the orientation-confirming member 11.

Further, a beam (not shown) which extends across the cutout portion 71*b* of the hand rest 71 may be provided to permit an operator to stably hold a scaler 9. Preferably, the beam is provided with handle-placing portions (not shown) which obliquely extend at different angles respectively corresponding to desired angles of handle axes.

Instead of the hand rest on which the operator's hand is placed, a support base (not shown) may be employed which is formed with a groove for receiving a handle of a scaler to thereby support the scaler per se.

For instance, the holding means is comprised of a fixture base adapted to be temporarily fixed on a surface of a base plate, a first rod vertically extending from the fixture base, a first clamp mounted to the first rod, a second rod extending through a hole formed in the first clamp and having a distal end portion thereof formed with a second clamp, and a third rod extending through a hole formed in the second clamp and having a distal end portion thereof formed with a scaler holding portion. The first clamp is vertically movable and rotatable relatively to the first rod. The second rod and the second clamp mounted thereon are horizontally movable relatively to the first clamp. The third rod and the scaler holding portion mounted thereon are horizontally movable and rotatable relatively to the second clamp. Thus, a desired orientation of the scaler held by the scaler holding portion can be achieved by variably adjusting the vertical moving position and the rotating position of the first clamp, the horizontal moving position of the second rod, and the horizontal moving position and the rotating position of the third rod.

Instead of a rod 21 comprised of one piece member, a guide member may be employed which is comprised of a first member attached to a holder 3 and a second member connected to the first member, and supporting sharpening stone assembly 4 moveably along the second member.

Instead of square pillar-like sharpening stones 95, 96 of the second embodiment, sharpening stones having a curved grinding surface may be employed for sharpening a round-shaped scaler blade. Moreover, disposable sharpening stones may be employed. A sharpening stone may be formed into a thin plate shape or may be comprised of a sandpaper. In this case, the thin plate-like sharpening stone or the sandpaper may be mounted on a rectangular parallelopiped support.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A manually-operated sharpening apparatus comprising:

a sharpening member for sharpening a blade of a dental instrument;

a guide member for guiding said sharpening member so as to be movable along the guide member;

a positioning-assist element for permitting an operator to orient said dental instrument in a state where a predetermined angle is formed between the blade of said dental instrument and the sharpening member; and a base plate having a substantially flat face, wherein said guide member is fixed to the substantially flat face of said base plate, said positioning-assist element includes a first positioning line drawn on the substantially flat face of the base plate and extending at the predetermined angle with respect to the guide member, and said positioning line does not constitute a hindrance in changing a part at which the blade of the dental instrument is abutted against the sharpening member and in moving the dental instrument on the base plate to adjust the posture of the dental instrument.

2. The sharpening apparatus according to claim 1, wherein the positioning line is substantially flush with the substantially flat face of the base plate.

3. A manually-operated sharpening apparatus comprising:

a sharpening member for sharpening a workpiece;

a guide member for guiding said sharpening member so as to be movable along the guide member;

a positioning-assist element for permitting an operator to dispose said workpiece in a state where a predetermined angle is formed between the workpiece and the sharpening member; and a base plate having a flat face;

wherein said guide member is fixed to the flat face of said base plate and said positioning-assist element is comprised of a positioning line drawn on the flat face of the base plate and extending at the predetermined angle with respect to the guide member; and wherein said guide member is disposed on the flat face of the base plate so as to be pivotable around one end of the guide member, and is adapted to be fixed at an arbitrary pivotal angular position.

4. The sharpening apparatus according to claim 3, further comprising:

an arcuate member fixed to the flat face of the base plate, wherein said guide member has another end thereof moving along the arcuate member as the guide member is pivoted.

5. A manually-operated sharpening apparatus comprising:

a sharpening member for sharpening a blade of a dental instrument;

a guide member for guiding said sharpening member so as to be movable along the guide member; and a positioning-assist element for permitting an operator to orient said dental instrument in a state where a predetermined angle is formed between the blade of said dental instrument and the sharpening member, wherein said guide member includes an elongated raised surface on said sharpening apparatus, and said sharpening member includes at least one sharpening stone, and a groove, the raised surface being engageable with the groove of the sharpening member, and the sharpening member being reciprocatable along the elongated raised surface.

6. A manually-operated sharpening apparatus comprising:

a sharpening member for sharpening a workpiece;

a guide member for guiding said sharpening member so as to be movable along the guide member;

a positioning-assist element for permitting an operator to dispose said workpiece in a state where a predetermined angle is formed between the workpiece and the sharpening member; and a holder, adapted to be placed on a flat face of a base, for holding said guide member in a state that the guide member extends at a predetermined angle with respect to the flat face of the base in an imaginary vertical plane which extends perpendicularly to the flat face of the base; and wherein said positioning-assist element is comprised of an orientation-confirming member detachably mounted to the workpiece and having a horizontal-indicating portion, adapted to be placed on a flat face of the workpiece, for permitting the operator to visibly judge whether the flat face of the workpiece is disposed in parallel to the flat face of the base, and the flat face of the workpiece is adjacent to a sharpened face of the workpiece and cooperates with the sharpened face to form a blade of the workpiece.

7. A manually-operated sharpening apparatus comprising:

a sharpening member for sharpening a workpiece;

a guide member for guiding said sharpening member so as to be movable along the guide member;

a positioning-assist element for permitting an operator to dispose said workpiece in a state where a predetermined angle is formed between the workpiece and the sharpening member; and a holder adapted to be placed on a flat face of a base, for holding said guide member in a state that the guide member extends at a predetermined angle with respect to the flat face of the base in an imaginary vertical plane which extends perpendicularly to the flat face of the base; and wherein said positioning-assist element is comprised of a hand rest on which the operator rests his or her hand, the hand rest having a peripheral wall thereof formed with a cutout portion through which the operator is enabled to project the workpiece, the peripheral wall of the hand rest having an inner surface on which at least one guide line is drawn, the operator being enabled to dispose the workpiece such that the predetermined angle is formed between the workpiece and the sharpening member, by disposing the workpiece in alignment with the at least one guide line.

8. The sharpening apparatus according to claim 2, wherein said positioning-assist element includes a second positioning line drawn on the substantially flat face of the base plate and obliquely extending with respect to said first positioning line; and wherein a region in which said second positioning line extends at least partially overlaps a region in which said first positioning line extends.

9. A manually-operated sharpening apparatus comprising:

a sharpening member for sharpening a blade of a dental instrument;

a guide member for guiding said sharpening member so as to be movable along the guide member; and a positioning-assist element for permitting an operator to orient said dental instrument in a state where a predetermined angle is formed between the blade of said dental instrument and the sharpening member, wherein said sharpening member is comprised of two sharpening stones and two caps respectively attached to opposite ends of the sharpening stones, each of the caps including at least one face with a guide groove extending longitudinally of the sharpening stones, said guide groove having a depth which is substantially the same as a height of the guide member and a width which is slightly wider than a width of the guide member.

10. A manually-operated sharpening apparatus comprising:

a sharpening member for sharpening a blade of a dental instrument;

a guide member for guiding said sharpening member so as to be movable along the guide member;

a positioning-assist element for permitting an operator to grasp said dental instrument in a state where a predetermined angle is formed between the blade of said dental instrument and the sharpening member; and a base plate having a flat face, wherein said guide member is fixed to the flat face of said base plate, said positioning-assist element includes a first positioning line drawn on the flat face of the base plate and extending at the predetermined angle with respect to the guide member and a second positioning line drawn on the flat face of the base plate and obliquely extending with respect to said first positioning line, a region in which said second positioning line extends at least partially overlapping a region in which said first positioning line extends, said first and second positioning lines not constituting a hindrance in changing a part at which the blade of the dental instrument is abutted against the sharpening member and in moving the dental instrument on the base plate to adjust the posture of the dental instrument, and said sharpening member includes two sharpening stones and two caps respectively attached to opposite ends of the sharpening stones, each of the caps including at least one face with a guide groove extending longitudinally of the sharpening stones, said guide groove having a depth which is substantially the same as a height of the guide member and a width which is slightly wider than a width of the guide member.

11. The sharpening apparatus according to claim 9, wherein the sharpening member can be reciprocated along the guide member, while moving in one direction the blade of the dental instrument kept in contact with one of said sharpening stones, and while moving in a second direction the blade kept out of contact with the sharpening stones.

12. The sharpening apparatus according to claim 10, wherein the sharpening member can be reciprocated along the guide member, while moving in one direction the blade of the dental instrument kept in contact with one of said sharpening stones, and while moving in a second direction the blade kept out of contact with the sharpening stones.

13. A manually-operated sharpening apparatus comprising:

a sharpening member for sharpening a blade of a dental instrument;

a guide member for guiding said sharpening member so as to be movable along the guide member;

a positioning-assist element for permitting an operator orient said dental instrument in a state where a predetermined angle is formed between the blade of said dental instrument and the sharpening member; and a base plate having a substantially flat facet, wherein the guide member includes a raised surface on the substantially flat face of the base plate, the positioning-assist element includes a line drawn on the base plate, and the sharpening member includes a groove, the raised surface engaging the groove of the guide member.

* * * * *